United States Patent [19]

Takahashi

[11] 4,069,556

[45] Jan. 24, 1978

[54] AUTOMATIC LOCK SLIDER

[75] Inventor: Kihei Takahashi, Uozu, Japan

[73] Assignee: Yoshida Kogyo K.K., Japan

[21] Appl. No.: 746,733

[22] Filed: Dec. 2, 1976

[30] Foreign Application Priority Data

Dec. 16, 1975 Japan ..... 50-171161[U]

[51] Int. Cl.[2] ..... A44B 19/30

[52] U.S. Cl. ..... 24/205.14 R

[58] Field of Search ..... 24/205.14 R, 205.14 K

[56] References Cited

U.S. PATENT DOCUMENTS

| | | | |
|---|---|---|---|
| 2,045,626 | 6/1936 | Winterhalter | 24/205.14 R |
| 2,289,955 | 7/1942 | Berg | 24/205.14 R |
| 2,697,261 | 12/1954 | Bernasconi | 24/205.14 R |
| 3,355,778 | 12/1967 | Elsenheinba | 24/205.14 R |
| 3,522,638 | 8/1970 | Ambros | 24/205.14 R |

FOREIGN PATENT DOCUMENTS

| | | | |
|---|---|---|---|
| 769,355 | 8/1967 | Canada | 24/205.14 R |
| 2,404,353 | 9/1974 | Germany | 24/205.14 R |
| 264,281 | 10/1948 | Switzerland | 24/205.14 R |
| 1,368,778 | 10/1974 | United Kingdom | 24/205.14 R |
| 1,377,451 | 1/1973 | United Kingdom | 24/205.14 R |

*Primary Examiner*—Bernard A. Gelak

*Attorney, Agent, or Firm*—Bucknam and Archer

[57] ABSTRACT

An automatic lock slider for a slide fastener comprises a slider body having a transverse slot formed in its upper wing, and a pull tab pivotally mounted on the slider body and having a tongue. A locking spring means is mounted on the slider upper wing and has a locking pawl received in the transverse slot. The pull tab tongue urges the locking pawl into the guide channel of the slider body along a curved path oriented transversely of the slider body for locking engagement with one of the fastener elements therewithin when the pull tab is laid flat toward the slider upper wing.

6 Claims, 6 Drawing Figures

AUTOMATIC LOCK SLIDER

BACKGROUND OF THE INVENTION

1. Field of the Invention

This invention relates generally to slide fasteners and more particularly to an automatic lock slider for slide fasteners which has a locking means capable of selectively locking the slider on the fastener elements against unintentional movement therealong.

2. Prior Art

A typical automatic lock slider of the type under consideration is well known in the art in which a locking spring member in the form of an elongated leaf spring or wire element is arranged longitudinally over the top or upper wing of the slider body. The locking spring member has one end anchored to the front end of the slider body and the other end bent inwardly to provide a locking pawl which is adapted to be introduced through an aperture formed in the top wing into the space between two adjacent fastener elements within the guide channel of the slider for locking the slider against movement along the fastener elements when the pull tab is laid flat against the top wing. The locking spring member also has a central humped or arched portion intermediate the opposite ends thereof. The pull tab has a transversely extending trunnion or pintle at one end thereof. The humped portion straddles and resiliently bears against the pull tab pintle to permit the pull tab to pivot thereabout between its flat and lifted positions. The pintle serves as a cam means which cooperates with the humped portion to move the locking pawl into and out of the space between adjacent fastener elements within the guide channel when the pull tab is actuated between its flat and lifted positions. The automatic lock slider has a drawback, however, in that the locking pawl oftentimes impinges upon one of the two adjacent fastener elements within the guide channel and fails to be smoothly introduced into the space between the fastener elements when the pull tab is actuated to its flat position, because the locking pawl moves between its locked and unlocked positions along a curved path oriented pitchwise of the fastener elements or in the longitudinal direction of the slide fastener. In such instance, the locking pawl is usually forcibly moved into the space between adjacent fastener elements within the guide channel by further pivotting the pull tab exactly to its flat position. This would result in accelerated wear of the locking pawl and give rise to premature malfunction of the automatic lock slider. Another disadvantage of the prior art slider is that when a severe pull tending to separate the opposed stringer tapes away from each other is exerted on the slide fastener with the slider held in its locked position, the locking pawl is forced toward the front end of the slider body by the fastener element, against which the locking pawl lockingly abuts, to permit the bend of the locking spring member into which the locking pawl merges to be deformed or yielded outwardly away from the slider top wing to such an extent that the function of the locking spring member is frequently adversely affected. This difficulty arises out of the fact that since the locking pawl moves along the curved path oriented pitchwise of the fastener elements, the aperture in the top wing through which the locking pawl is introduced into the guide channel has to have a relatively large size or length in the longitudinal direction of the slide fastener. Further, since the locking spring member is made of a leaf spring or wire element of a length sufficient to withstand operating fatigue and to be durable over an extended period of time, the slider body must necessarily be made long enough to permit such a relatively long spring member to be mounted longitudinally over the top wing.

SUMMARY OF THE INVENTION

It is therefore an object of this invention to provide an automatic lock slider for slide fasteners in which there is provided a locking spring member which is capable of locking the slider on the fastener elements against movement therealong in a smooth, reliable manner and is durable over a prolonged period of time.

Another object is to provide a locking spring member which enables the slider body to be made relatively short to provide a compact slider.

According to the invention, there is provided an automatic lock slider for a slide fastener comprising a slider body having a pair of parallel, spaced apart upper and lower wings interconnected by a neck located centrally of its front end to define a generally Y-shaped guide channel through the slider body. The upper wing has a longitudinally extending groove formed in the outer surface thereof, the groove terminating in a transversely extending slot at its end remote from the front end of the slider body, and the slot extending through the upper wing. A pull tab has a tongue at its one end and is mounted on the upper wing for pivotal movement between its flat and lifted positions. A locking spring means is mounted longitudinally on the upper wing and has one end anchored to the front end of the slider body, the locking spring means having a locking pawl received in the transverse slot. The locking spring means resiliently engages the pull tab tongue in such a manner that when the pull tab is actuated to its lifted position, the tongue urges the locking pawl to turn about an axis parallel to the longitudinal axis of the slider body into the guide channel along a curved path oriented transversely of the longitudinal axis.

Many other advantages and feature of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
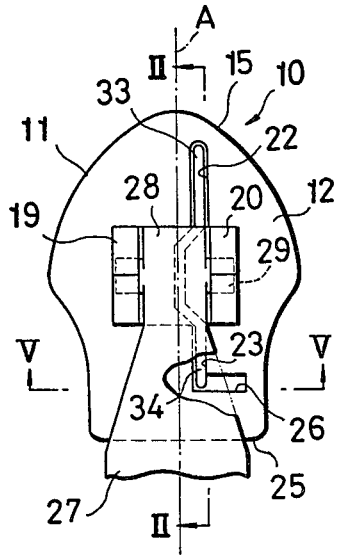
FIG. 1 is a top plan view of an automatic lock slider according to this invention.
Figure 2:
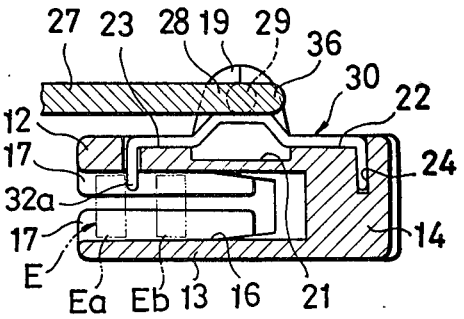
FIG. 2 is a cross-sectional view taken along the line II—II of FIG. 1 with a pull tab in its flat position.

As best shown in FIGS. 1 and 2, an automatic lock slider 10 includes a body 11 having a pair of parallel, spaced apart upper and lower wings or plates 12,13 interconnected by a neck or web 14 located centrally of its front end 15 to define a generally Y-shaped guide channel 16 through the slider body 11 to permit rows of interengageable fastener elements E carried along the opposed edges of stringer tapes (not shown) to pass therethrough to open and close a slide fastener (not shown). Each of the upper and lower wings 12,13 has a pair of inwardly directed flanges 17,18 formed on and along lateral edges thereof.

Formed intergrally with the upper wing 12 is a pair of laterally spaced apart ears 19,20 which are disposed approximately centrally of the length of the slider body 11 and spaced equidistantly from the longitudinal axis A of the slider body 11. The upper wing 12 has a depression 21 formed in the outer surface thereof and extending between the pair of ears 19,20, the depression 21 being rectangular in shape when viewed in a direction perpendicular to the plane of the upper wing 12. The upper wing 12 also has a pair of elongated front and rear grooves 22,23 formed in its outer surface and spaced along the length of the slider body 11, the grooves having a common axis lying parallel to the longitudinal axis A and immediately adjacent to the ear 20 as best shown in FIG. 1. The grooves 22,23 extend respectively into the rectangular depression 21 at their opposed ends, and the depression 21 is of greater depth than the grooves 22, 23 as shown in FIG. 2. The front groove 22 terminates short of the front end 15 of the slider body 11 and extends through the upper wing 12 into the neck 14 to provide a retaining hole 24 with an axis lying substantially perpendicularly to the plane of the upper wing 12. The rear groove 23 terminates short of the rear end 25 of the slider body 11 and ends in a slot 26 formed through the upper wing 12 and extending transversely to the longitudinal axis A away therefrom.

Figure 3:
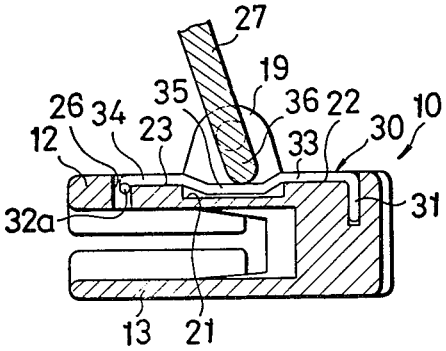
FIG. 3 is a view similar to FIG. 2 with the pull tab in its lifted position.

A pull tab 27 fragmentarily shown in the drawings comprises an elongated plate member and is tapered from its central portion toward its front end and terminates in a narrower tongue 28 of rectangular shape having a width slightly less than the distance between the pair of ears 19,20 so as to be received therebetween. The pull tab 27 has a pintle 29 of substantially circular cross section extending through the rectangular tongue 28 and rotatably journalled in the ears 19,20 at its opposite ends to permit the pull tab 27 to pivot about the pintle 29 between its flat position (FIG. 2) and lifted position (FIG. 3). When the pull tab 27 is laid flat, the rectangular tongue 28 is disposed in overlying relation to the depression 21 substantially in registry therewith.

Figure 4:
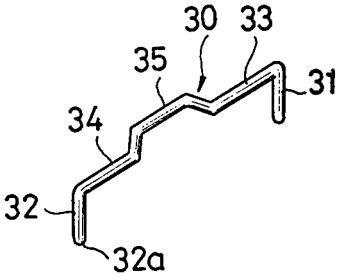
FIG. 4 is a perspective view of a locking spring member incorporated in the slider.

According to the invention, a locking spring member 30 is provided for automatically locking the slider 10 on the fastener elements E against movement therealong when the pull tab 27 is actuated to its flat position. The locking spring member 30 comprises a resilient wire element of substantially circular cross section which is bent at its opposite ends substantially right-angularly to its central major portion to provide a pair of front and rear legs 31,32 as shown in FIG. 4. The central portion is also bent or raised away from the legs 31,32 substantially centrally thereof to provide a pair of front and rear straight sections 33,34 and a humped or arched section 35 lying therebetween. The distal or free end **32*a* of the rear leg 32 serves as a locking pawl which moves into the guide channel 16** for locking engagement with the fastener element E*a* when the pull tab 27 is actuated to its flat position, as will hereinafter more fully be described.

Figure 5:
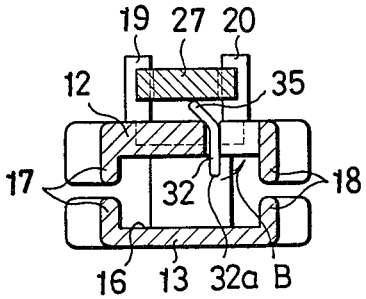
FIG. 5 is a cross-sectional view taken along the line V—V of FIG. 1.

The spring member 30 is mounted longitudinally on the upper wing 12 with the front leg 31 snugly received in the retaining hole 24 and with the front and rear straight sections 33,34 received in the front and rear grooves 22,23 respectively. The diameter of the spring member 30 is substantially equal to the depth of each of the grooves 22,23 so that the straight sections 33,34 lie substantially flush with the outer surface of the upper wing 12 as shown in FIGS. 2 and 3. The width of each of the grooves 22,23 is slightly greater than the diameter of the spring member 30. The rear leg 32 is also loosely received in the transverse slot 26. The humped section 35 is angularly oriented with respect to the legs 31,32 when viewed in the direction of the length of the spring member as shown in FIG. 5. The angular orientation of the humped section 35 is such that the humped section 35 resiliently bears against the lower surface of the pull tab tongue 28 when the pull tab 27 lies flat.

The tip end 36 of the pull tab tongue 28 extending beyond the pintle 29 serves as a cam means, and when the pull tab 27 is pivoted to its lifted position, the tip end 36 urges the angularly oriented humped section 35 to turn or angularly move against the bias of the spring member 30 in a counterclockwise direction about a common axis of the straight sections 33,34 received in the grooves 22,23 when viewed from the rear end of the slider body 11 (FIG. 5), thereby forcing the humped section 35 into the rectangular depression 21 as shown in FIG. 3. In this condition, since the front leg 31 is held fast in the retaining hole 24, the straight sections 33,34 are subjected to torsional forces to permit the unfastened rear leg 32 loosely received in the transverse slot 26 to rotate or angularly move in a counterclockwise direction about the common axis of the straight sections 33,34 as indicated by an arrow B in FIG. 5, thereby retracting the locking pawl **32*a*** held in locking engagement with the fastener element E*a* from the guide channel 16 into the slot 26 as shown in FIG. 3. When the pull tab 27 is pivoted back to its flat position, the humped section 35 is retracted from the depression 21 to its raised position to again bear against the lower surface of the pull tab tongue 28 due to the resiliency of the spring member 30. The rear leg 32 is also turned clockwise back to the end of the transverse slot 26 lying adjacent to the longitudinal axis A to again introduce the locking pawl **32*a*** into the space between the fastener elements E*a*,E*b*, which space is disposed in underlying relation to the slot 26. The locking pawl **32*a*** usually lockingly engages the fastener element E*a*, since a lateral pull tending to separate the opposed stringer tapes, attached to an opening of a garment, away from each other is usually exerted on the slide fastener to urge the slider 10 to move in the fastener opening direction.

Figure 6:
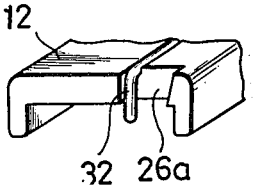
FIG. 6 is a fragmentary, perspective view of a modified slider.

FIG. 6 shows a modified form of the invention in which the transverse slot 26 is replaced by a cut-away or notched recess **26*a* formed in the rear edge of the upper wing 12**.

Since the locking pawl **32*a* is movable between its locked and unlocked positions along a curved path oriented transversely of the longitudinal axis A, the locking pawl 32*a*** can advantageously be smoothly introduced into the space between the fastener elements E*a*,E*b* without frequently striking against either of them.

The locking spring member 30 takes advantage of the torsional forces exerted thereon, which enables the spring member 30 to withstand operating fatigue and be durable over an extended period of time even when the spring member is made relatively short. This is advantageous in that the slider body 11 can also correspondingly be reduced in length to provide the slider 10 in a compact form.

What is claimed is:

1. An automatic lock slider for a slide fastener comprising:

a. a slider body having a pair of parallel, spaced-apart upper and lower wings interconnected by a neck located centrally of its front end to define a generally Y-shaped guide channel through said slider body for the longitudinal passage of rows of slide fastener elements, said slider body having a slot extending through said upper wing and oriented transversely to the longitudinal centerline of the slider body;

b. a pull tab having a tongue at one end and mounted on said upper wing for pivotal movement relative thereto between flat and uplifted positions; and c. a resilient locking spring means mounted on said upper wing, said locking spring means having a locking pawl at one end received in said transverse slot, said locking spring means resiliently engaging said pull tab tongue for operation thereby, said locking spring means being responsive to the pivotal movement of the pull tab whereby the locking spring means twists about an axis parallel to the longitudinal centerline of the slider body to sweep said locking pawl along a curved path oriented transversely to said axis, said locking pawl being extended into said guide channel for locking engagement with the fastener elements when the pull tab is in said flat position, and said locking pawl being retained in said slot out of locking engagement with the fastener elements when the pull tab is in said uplifted position.

2. An automatic lock slider according to claim 1, in which a retaining hole with an axis lying perpendicularly to the plane of said upper wing is formed in the front end of said slider body, and in which said locking spring means comprises an elongated resilient element having opposite ends thereof bent inwardly to provide a pair of front and rear legs received in said retaining hole and said transverse slot, respectively, the distal end of said rear leg serving as said locking pawl, the major portion of said elongated element between said legs having its central portion raised away from said upper wing to provide a projecting section resiliently bearing against the undersurface of said pull tongue and a pair of straight sections longitudinally spaced by said projecting section and received in said longitudinal groove, and said projecting section being normally oriented angularly with respect to said legs whereby when said pull tab is actuated to its lifted position, said pull tab tongue urges said projecting section to angularly move about a common axis of said straight sections against the bias of said resilient element so that said rear leg is also angularly turned said common axis to retract said locking pawl from said guide channel.

3. An automatic lock slider according to claim 2, in which said upper wing has a pair of laterally spaced apart ears formed on its outer surface, said pull tab has a pintle transversely extending through said pull tab tongue, said pintle being journalled in said ears at its opposite ends, and said upper wing has depression formed in the outer surface thereof and laterally extending between said pair of ears and intersecting said longitudinal groove to provide a pair of shorter grooves on opposite sides thereof, said shorter grooves receiving said straight sections, respectively, and said depression being of greater depth than said shorter grooves and disposed in underlying relation to said pull tab tongue when said pull tab lies flat whereby said projecting section is urged into said depression by said pull tab tongue when said pull tab is actuated to its lifted position.

4. An automatic lock slider according to claim 3, in which said front and rear legs are disposed substantially right-angularly to said straight sections, and said projecting section is substantially trapezoidal in contour when viewed in the transverse direction of said slider body.

5. An automatic lock slider according to claim 3, in which said projecting section and said rear leg are angularly turned in a counterclockwise direction when viewed from the rear end of said slider body.

6. An automatic lock slider according to claim 1 in which said transverse slot is formed in the rear edge of said upper wing.

* * * * *